US005490733A

United States Patent [19]

Asano

[11] Patent Number: 5,490,733

[45] Date of Patent: Feb. 13, 1996

[54] RECORDING APPARATUS AND METHOD OF INK SHEET TYPE DETERMINATION

[75] Inventor: Shinya Asano, Tokyo, Japan

[73] Assignee: Canon Kabushiki Kaisha, Tokyo, Japan

[21] Appl. No.: 313,395

[22] Filed: Sep. 27, 1994

Related U.S. Application Data

[63] Continuation of Ser. No. 99,392, Jul. 30, 1993, abandoned, which is a continuation of Ser. No. 689,518, Apr. 23, 1991, abandoned.

[30] Foreign Application Priority Data

Apr. 24, 1990 [JP] Japan ..... 2-106602

[51] Int. Cl.[6] ..... B41J 33/14

[52] U.S. Cl. ..... 400/223; 400/224.1; 400/247; 400/697.1

[58] Field of Search ..... 400/194, 196, 400/196.1, 207, 208, 216.1, 223, 224.1, 227.2, 247, 249, 237, 217, 248.3, 70, 76, 144.2, 320, 697.1, 695, 696, 697

[56] References Cited

U.S. PATENT DOCUMENTS

| | | | |
|---|---|---|---|
| 4,611,938 | 9/1986 | Rettke et al. | 400/217 |
| 4,697,942 | 10/1987 | Yagi | 400/208 |
| 4,787,763 | 11/1988 | Kondo | 400/217 |
| 4,797,018 | 1/1989 | Hofmann et al. | 400/249 |
| 4,880,325 | 11/1989 | Ueda et al. | 400/249 |
| 4,900,171 | 2/1990 | Mueller et al. | 400/249 |
| 5,006,003 | 4/1991 | Harada | 400/697.1 |
| 5,078,523 | 1/1992 | McGourty et al. | 400/207 |
| 5,082,381 | 1/1992 | Kishida et al. | 400/208 |
| 5,248,994 | 9/1993 | Yoshida et al. | 346/76 PH |
| 5,369,422 | 11/1994 | Yoshida et al. | 346/76 PH |
| 5,371,523 | 12/1994 | Wada et al. | 346/76 PH |
| 5,384,584 | 1/1995 | Yoshida et al. | 346/76 PH |

FOREIGN PATENT DOCUMENTS

| | | | |
|---|---|---|---|
| 3109299 | 1/1982 | Germany | 400/208 |
| 3711934 | 10/1988 | Germany | 400/208 |
| 0162684 | 12/1981 | Japan | 400/217 |
| 0073889 | 4/1985 | Japan | 400/120 MP |
| 0192677 | 10/1985 | Japan | 400/208 |
| 0121081 | 6/1987 | Japan | 400/237 |
| 0140870 | 6/1987 | Japan | 400/237 |
| 0125381 | 5/1988 | Japan | 400/237 |
| 1218879 | 9/1989 | Japan | 400/237 |

OTHER PUBLICATIONS

"Apparatus for Altering Ribbon Feed Increments" IBM Tech. Discl. Bulletin, vol. 26, No. 1, Jun. 1983, pp. 301–302.

*Primary Examiner*—Eugene H. Eickholt

*Attorney, Agent, or Firm*—Fitzpatrick, Cella, Harper & Scinto

[57] ABSTRACT

A recording apparatus for performing recording by transferring ink on an ink sheet onto recording medium includes a sensor for determining the type of ink sheet to be used for recording, a recorder for performing recording by transferring the ink on the ink sheet onto the recording medium, and a controller for controlling the relative movement of the ink sheet with respect to the recorder during the recording performed by the recorder in accordance with the type of ink sheet determined by the sensor.

18 Claims, 12 Drawing Sheets

FIG. 8

| TYPE OF INK RIBBON | VERTICAL DISPLACEMENT | HORIZONTAL MOVEMENT |
|---|---|---|
| SINGLE STRIKE RIBBON CORRECTABLE RIBBON | $y_1 = 6$ | $x_1 = 10$ |
| MULTI STRIKE RIBBON | $y_2 = 2$ | $x_2 = 5$ |

RECORDING APPARATUS AND METHOD OF INK SHEET TYPE DETERMINATION

This application is a continuation of application Ser. No. 08/099,392 filed Jul. 30, 1993, now abandoned, which is a continuation of application Ser. No. 07/689,518 filed Apr. 23, 1991, also abandoned.

BACKGROUND OF THE INVENTION

1. Field of the Invention

The present invention relates to a recording apparatus, such as a printer or an electronic typewriter, and more particularly, to a recording apparatus for performing recording on recording media, such as recording paper, using an ink sheet.

2. Description of the Related Art

Conventional typewriters for performing printing by striking characters on a sheet of printing paper through an ink ribbon use a single strike ribbon or a correctable ribbon which permits the same portion thereof to be used once for recording. In such typewriters, in order to enhance the efficiency with which the ink ribbons are used, the transferring portion of the ink ribbon is shifted in a circulating fashion for recording letters by successively shifting the ink ribbon which is as wide as, for example, three letters in the vertical direction in three stages by displacements of y1, each of which is the maximum letter height plus a slight height ($\alpha$), as shown in FIG. 6, while conveying the ink ribbon in the horizontal direction by movements of x1, each of which is the maximum letter width plus a slight amount ($\beta$).

Ink ribbons which permit the same portion thereof to be used (to be struck) a plurality of times,. Such as multi-strike ribbons, are also known. If recording is performed using the multi-strike ink ribbon in a circulating fashion by shifting the multi-strike ink ribbon in the vertical direction by a plurality of displacements y1 and by conveying it in the horizontal direction by a plurality of displacements x1 in the above-described conventional manner, no portion of the multi-strike ink ribbon is struck a plurality of times, thus decreasing the efficiency with which the multi-strike ink ribbon is used.

SUMMARY OF THE INVENTION

It is an object of the present invention to overcome the problems of the prior art.

It is another object of the present invention to provide a recording apparatus which enables an ink sheet to be used appropriately without reducing recording quality.

It is still another object of the present invention to provide a recording apparatus which enhances the efficiency with which an ink sheet is used by changing the relative movement of the ink sheet with respect to a recording head in accordance with the type of ink sheet used.

According to one aspect, the present invention which achieves these objectives relates to a recording apparatus for performing recording by transferring ink on an ink sheet onto recording medium, comprising determining means for determining the type of ink sheet to be used for recording; recording means for performing recording by transferring the ink on the ink sheet onto the recording medium, and control means for controlling the relative movement of the ink sheet with respect to the recording means during the recording performed by the recording means in accordance with the type of ink sheet determined by the determining means.

The apparatus also comprises displacing means for displacing the ink sheet in the vertical direction relative to the recording means. The control means controls the displacing means to change the vertical displacement in accordance with the type of ink sheet determined by the determining means. In addition, the control means controls the distance the ink sheet is conveyed in a horizontal direction relative to the recording means in accordance with the type of ink sheet determined by the determining means.

In one embodiment, the determining means mechanically detects the configuration of a portion of a cassette for accommodating the ink sheet in accordance with the type of accommodated ink sheet. In another embodiment, the determining means optically detects the reflectance of cassettes for accommodating different ink sheets. The cassettes accommodating different ink sheets have different reflectances. The determining means determines the type of ink sheet in accordance with the difference in reflectances of the different cassettes. In still another embodiment, the determining means optically detects the reflectance of the rear surfaces of different types of ink sheets. The rear surfaces of different types of ink sheets have different reflectances. The determining means determines the type of ink sheet in accordance with the difference in reflectances of the rear surfaces of different types of ink sheets.

The apparatus can be used with different types of ink sheets such as a single strike ribbon, a multi-strike ribbon, or a correction ink ribbon.

The recording means can comprise a printer for performing recording comprising a character wheel and a hammer. The hammer is adapted to strike a character on the character wheel, thereby pressing the character against the ink sheet, and thereby transferring the ink on the ink sheet onto the recording medium. In another embodiment, the ink sheet is a heat-transfer ink ribbon. In this embodiment, the recording means comprises a heat-transfer printer for performing heat-transfer recording using the heat-transfer ink ribbon.

According to another aspect, the present invention which achieves these objectives relates to a recording apparatus for performing recording on a recording medium by striking an ink sheet with a character hammer. The apparatus comprises determining means for determining the type of ink sheet to be used for recording, and recording means for performing recording by transferring the ink on the ink sheet onto the recording medium. The recording means comprises a recording head adapted to strike the character against the ink sheet to perform recording. The apparatus further comprises control means for controlling the relative movement of the ink sheet with respect to the recording head during the recording performed by the recording means in accordance with the type of ink sheet determined by the determining means.

According to still another aspect, the present invention which achieves these objectives relates to a recording apparatus for performing recording by heat transferring ink on a heat transfer ink sheet onto recording medium. The apparatus comprises determining means for determining the type of ink sheet used for recording, and recording means for transferring the ink on the heat transfer ink sheet onto the recording medium for recording. The recording means comprises a recording head which heat transfers the ink on the heat transfer ink sheet onto the recording medium. The apparatus further comprises control means for controlling the relative movement of the heat transfer ink sheet with respect to the recording head during the recording performed by the recording means in accordance with the type of heat transfer ink sheet determined by the determining means.

BRIEF DESCRIPTION OF THE DRAWINGS

FIG. 8 shows the displacements and movements of the single and multi-strike ink ribbons used in the embodiment shown in FIG. 1;

DETAILED DESCRIPTION OF THE PREFERRED EMBODIMENTS

Figure 1:
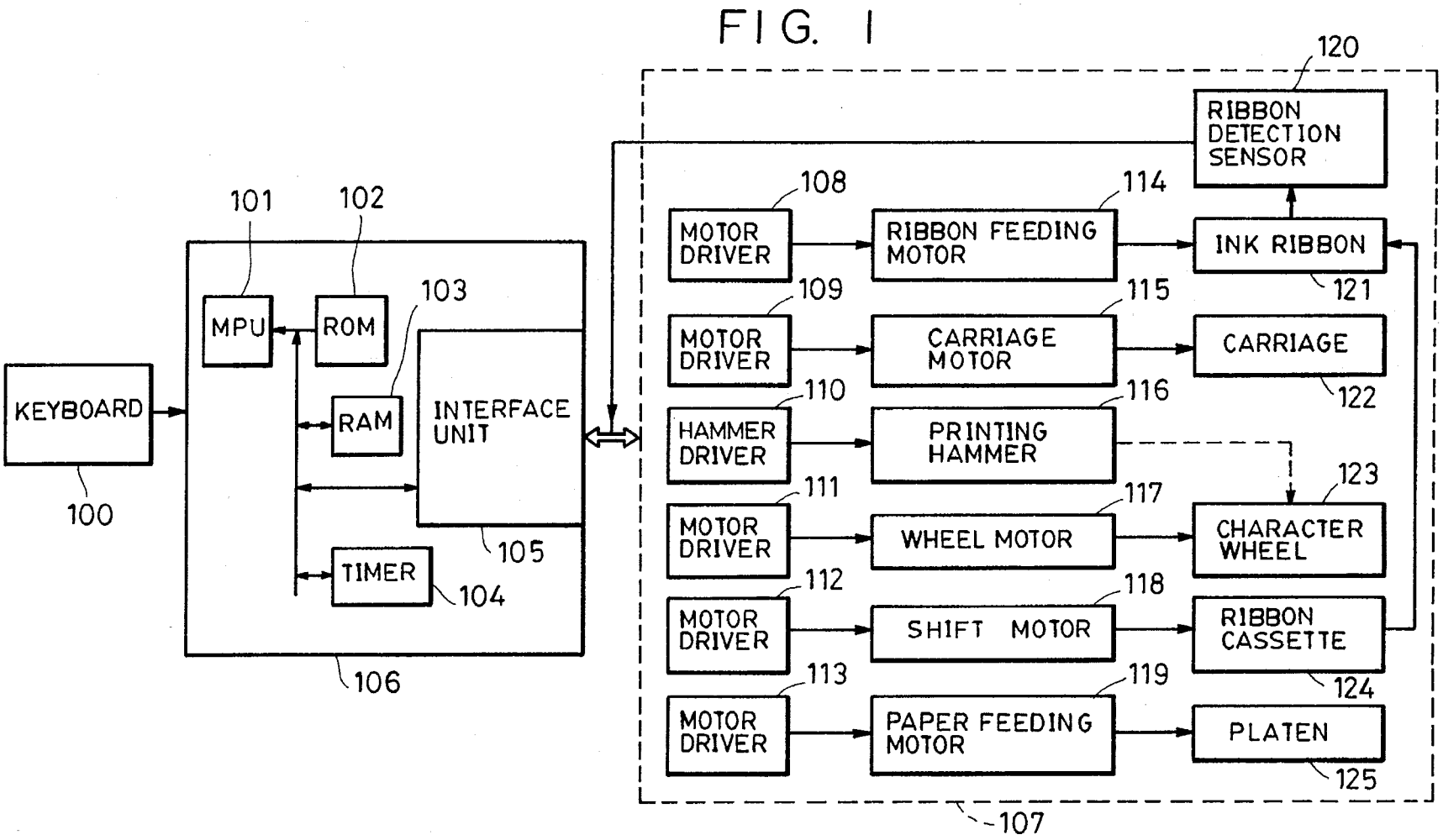
FIG. 1 is a block diagram showing a control portion and a printing mechanism portion of an embodiment of an electronic typewriter according to the present invention.
Figure 2:
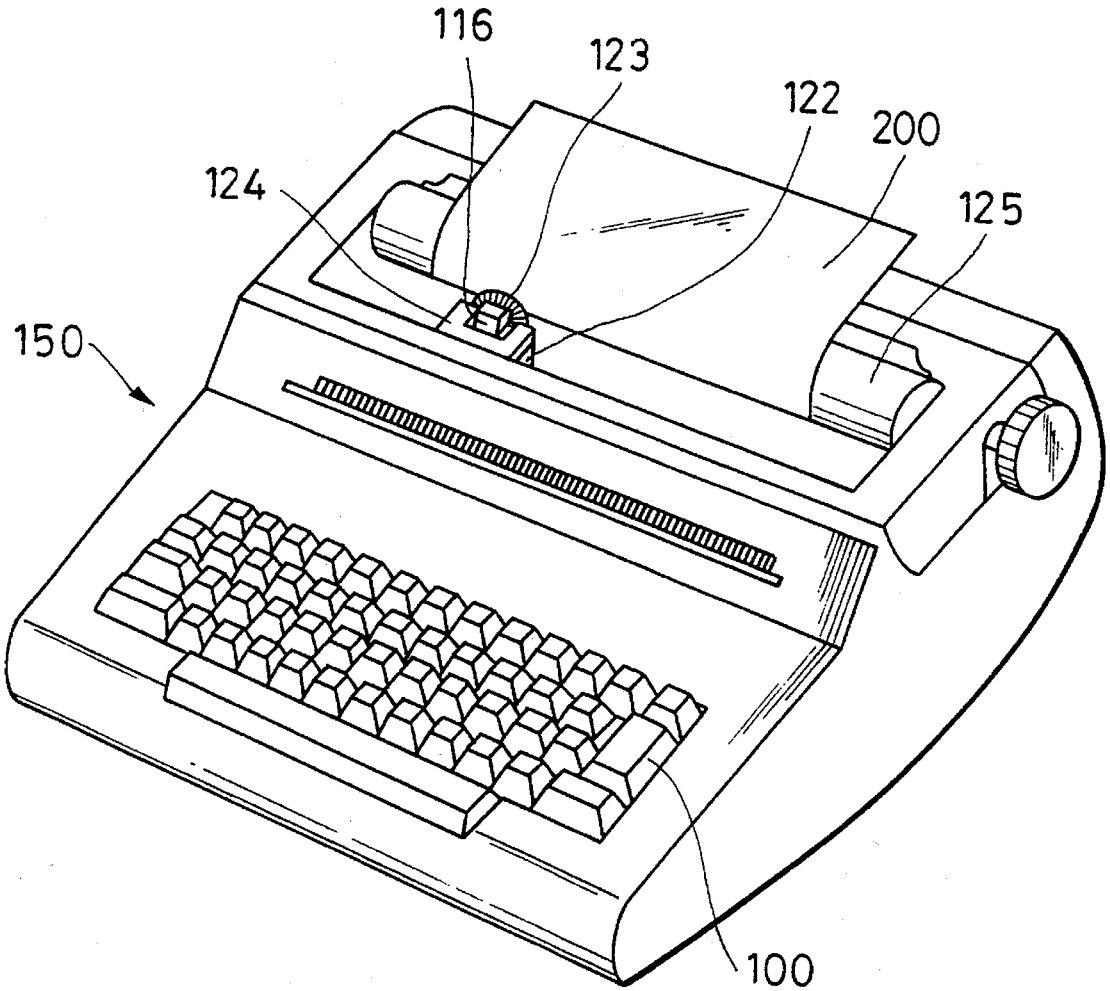
FIG. 2 is a perspective view of the electronic typewriter of FIG. 1.

In FIGS. 1 through 5, which explain the configuration of an embodiment of an electronic typewriter according to the present invention, FIG. 2 is a perspective view of an electronic typewriter 150, FIG. 1 is a block diagram of a control system for controlling the electronic typewriter of FIG. 2, and FIGS. 3 to 5 explain the structure and operation of a shifting mechanism for shifting an ink ribbon.

First, a typewriter 150 to which the present invention is applied will be outlined below with reference to FIG. 2.

As shown in FIG. 2, the typewriter 150 has on the side thereof closer to an operator a keyboard 100 on which a group of character input keys and a group of various function keys are disposed. The operator inputs printing data and various instruction data through the keyboard 100. Printing is conducted on a sheet of recording paper 200 in accordance with the input data by a printer mechanism portion provided on the side of the typewriter 150 which is remote from the operator.

The printing mechanism portion includes a platen 125 on which the sheet of recording paper 200 which serves as a recording medium is wound. The platen 125 conveys the sheet of recording paper 200 when it is rotated by a paper feed motor 119 (FIG. 1). The platen 125 also serves as a recording table which receives blows of the characters during printing. In the vicinity of the platen 125 is provided a carriage 122 which is moved to the right and left along the platen 125 by the drive of a carriage motor 115 (FIG. 1) in the two directions. On the carriage 122 are mounted a printing hamer 116 which is a recording head, a character wheel 123 on which a group of characters are disposed in a radial fashion, and a wheel motor 117 for rotating the wheel 123 and thereby selecting a desired character.

The ink ribbon shifting mechanism will now be described with reference to FIGS. 3 to 5.

The carriage 122 mounts a ribbon cassette 124 for accommodating an ink ribbon 121 in an extended fashion. The ribbon cassette 124 is detachably held on 8 ribbon frame 13, which is supported on a support member 14 provided on the carriage 122 in such a manner as to be rotatable about a shaft 15 in the directions indicated by arrows 'A' and 'B'.

On one side of the distal end (the side closer to the platen 125) of the ribbon frame 13 is provided a downwardly curved portion 13*a*. A fan-shaped shift gear 16 whose center is the shaft 15 which is the rotational center of the ribbon frame 13 is fixed to the curved portion 13*a*.

The shift gear 16 meshes with a pinion gear 17 of a shift motor 118 (FIG. 1) mounted on the carriage 122, by which the ribbon frame 13 is pivoted in the direction indicated by the arrow 'A' through the shift gear 16 by the rotation of the pinion gear 17 in the direction indicated by an arrow 'a'. This pivot of the ribbon frame 13 shifts up the ink ribbon 121 provided in the ribbon cassette 124 from the waiting position shown in FIG. 3 to either of the striking positions shown in FIGS. 4 and 5. Conversely, rotation of the pinion gear 17 in the direction indicated by an arrow 'b' causes the ribbon frame 13 to be pivoted in the direction indicated by the arrow 'B'. This pivot of the ribbon frame 13 shifts down the ink ribbon 121. Consequently, the height of the extended portion of the ink ribbon 121 can be controlled such that a desired vertical position of the extended portion of the ink ribbon 121 can be located at a strike position by controlling the rotational position of the shift motor 118.

Figure 3:
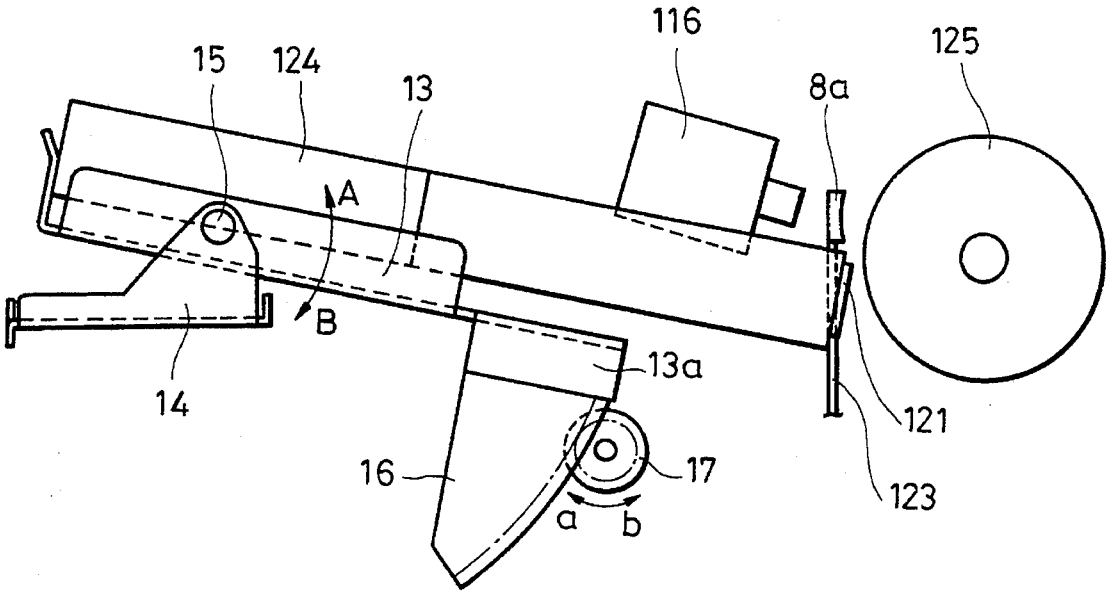
FIGS. 3 to 5 explain an ink ribbon shifting mechanism.

FIG. 3 shows the waiting position of the ink ribbon 121 at which the extended portion of the ink ribbon 121 is located below the striking position where the hammer 116 strikes a character 8*a* of the character wheel 123 so that the typist can see the letters printed on the sheet of recording paper 200. FIG. 4 shows a printable state in which the upper portion of the extended portion of the ink ribbon 121 is located at the striking position of the character 8*a*, and FIG. 5 shows a printable state in which the lower portion of the extended portion of the ink ribbon 121 is located at the striking position of the character 8*a*. Therefore, the intermediate portion of the extended portion of the ink ribbon 121 can be located at the striking position of the character 8*a* by stopping the rotation of the shift motor 118 at the midpoint of the positions shown in FIGS. 4 and 5.

The ribbon cassette 124 has a built-in mechanism for supplying and taking up the ink ribbon 121 accommodated in the ribbon cassette 124. When the taking up mechanism is driven by a ribbon feed motor 114 (FIG. 1) mounted on the carriage 122 so as to take up the ink ribbon 121, the portion of the ink ribbon 121 extending between the character wheel 123 and the platen 125 is fed in the horizontal direction (in the direction in which the carriage 122 is moved). The amount of rotation of the ribbon feed motor 114 can be controlled desirably by the operator. The movement of the extending portion of the ink ribbon 121 in the horizontal direction can be set to a desired value by controlling this amount of rotation of the ribbon feed motor 114.

In the ink ribbon shifting mechanism arranged in the manner described above, the character wheel 123 is rotated in accordance with the input key operation on the keyboard 100, and a desired character is thereby selected and located at a position where it is struck by the printing hammer 116. As the printing hammer 116 strikes the selected character, the character strikes the recording paper 200 through the ink ribbon 121 located at the strike position, by which the ink on the ink ribbon 121 is transferred and printed on the recording paper 200.

The ink ribbon 121 is shifted in the vertical direction by a fixed displacement determined in accordance with the type of ink ribbon 121 by the rotation of the shift motor 118 and is conveyed in the horizontal direction through a predetermined movement by the ribbon feed motor 114. Thus, the ink ribbon 121 is sequentially displaced and conveyed to the strike position by repeating the aforementioned operations.

Figure 6:
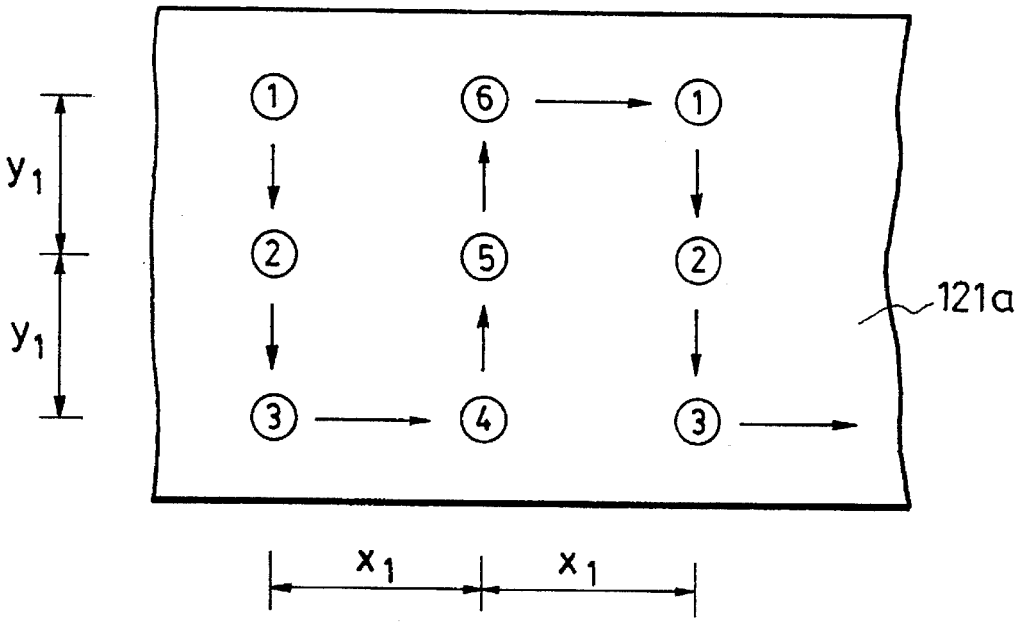
FIG. 6 shows the state in which a single strike ink ribbon is used.
Figure 7:
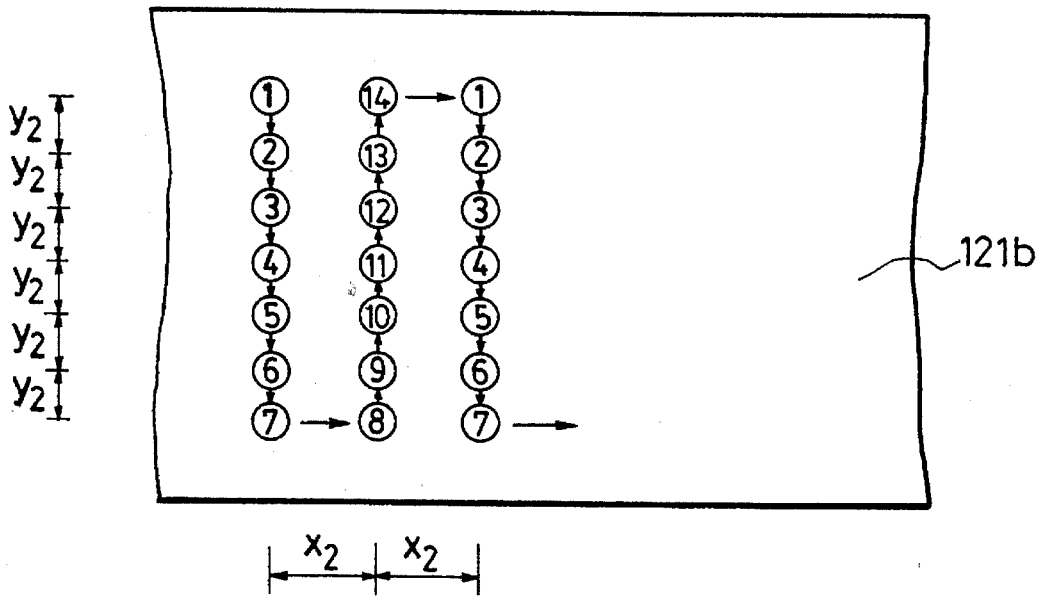
FIG. 7 shows the state in which a multi-strike ink ribbon is used.

In this embodiment, the displacement and movement of a single strike or correctable ribbon which permits the same portion thereof to be used once are respectively set to y1 and x1, and displacement and movement of a multi-strike ribbon which permits the same portion thereof to be used a plurality of times are respectively set to y2 and x2. FIGS. 6 and 7 respectively show the state in which the respective ink ribbons 121*a* and 121*b* are used.

FIG. 6 shows a state in which the single strike or correctable ribbon 121*a* is used. The displacement y1 corresponds to a value which is the maximum letter height + α. In this embodiment, an ink ribbon having a width corresponding to three letters can be moved in three stages in the vertical direction. The movement x1 corresponds to a value which is the maximum letter width +β. Consequently, no portion of the ink ribbon is used twice during recording.

As shown in FIG. 6, the recording position on the ink ribbon 121*a* shifts in the order of ①→②→③→④→⑤→⑥. FIG. 4 shows the positional relation between the ink ribbon 121 and the character 8*a* which strikes position ① or ⑥. FIG. 5 shows the state in which the character 8*a* is striking position ③ or ④. The intermediate state between those shown in FIGS. 4 and 5 represents the state in which the character 8*a* is striking position ② or ⑤.

FIG. 7 shows a state in which a multi-strike ink ribbon 121*b* is used. The displacement y2 is equal to y1 /3, and the movement x2 equals to x1 / 2. In this way, the ink ribbon 121*b* can be moved in seven stages in the vertical direction. As a result, the ink ribbon shown in FIG. 7 is used in an overlapped fashion in the vertical and horizontal directions.

Next, the control system of the typewriter 150 will be described below with reference to FIG. 1.

FIG. 1 is a block diagram of the electronic typewriter 150 according to the present invention. In FIG. 1, a reference numeral 106 denotes a control portion for controlling the typewriter 150 by outputting various types of control signals in accordance with a control program. The control portion 106 includes a microprocessor (MPU) 101, a read only memory (ROM) 102 for storing various types of data required for the control program of the MPU 101 and control of the typewriter, a random access memory (RAM) 103 used as the working area of the MPU 101, a timer 104 for performing counting on the basis of an instruction signal from the MPU 101 and outputting time information, and an interface portion 105 for performing input/output of various signals. The control portion 106 controls a printing mechanism portion 107 which executes the printing operation in accordance with the input from the keyboard 100.

The printing mechanism portion 107 includes a ribbon feed mechanism for feeding the ink ribbon 121 in its lengthwise direction comprising a ribbon feed motor 114 driven through a motor driver 108, a carriage moving mechanism for moving the carriage 122 comprising a carriage motor 115 driven through the motor driver 109, a hamer driving mechanism for driving the printing hamer 116 through a hammer driver 110, a selecting letter mechanism for selecting a desired character by rotating the character wheel 123 by the wheel motor 117 driven through a motor driver 111, a shift mechanism for shifting the ribbon cassette 124 by the shift motor 118 driven through a motor driver 112, and a paper feeding mechanism for conveying the recording paper 200 by rotating the platen 125 by the paper feeding motor 119 driven through a motor driver 113.

Figure 11:
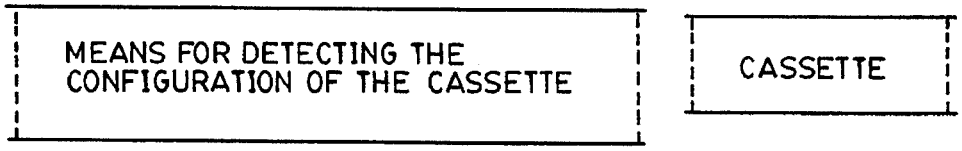
FIG. 11 shows a block diagram of an alternative embodiment in which a sensor is provided for detecting the configuration of the cassette.

In this embodiment, the printing mechanism portion 107 further includes a ribbon detection sensor 120 for detecting the type of ink ribbon 121 mounted on the carriage 122 and for sending the result to the control portion 106. The ribbon detection sensor 120 is adapted to mechanically or optically detect the type of ink ribbon 121 utilizing the form of, for example, a protrusion or notch provided on the ribbon cassette 124 with a sensor as shown in FIG. 11 or the reflectance of a reflecting member adhering to the ribbon cassette 124.

An example of the apparatus and method of optically detecting the type of ink ribbon 121 will be described below.

Figure 10A:
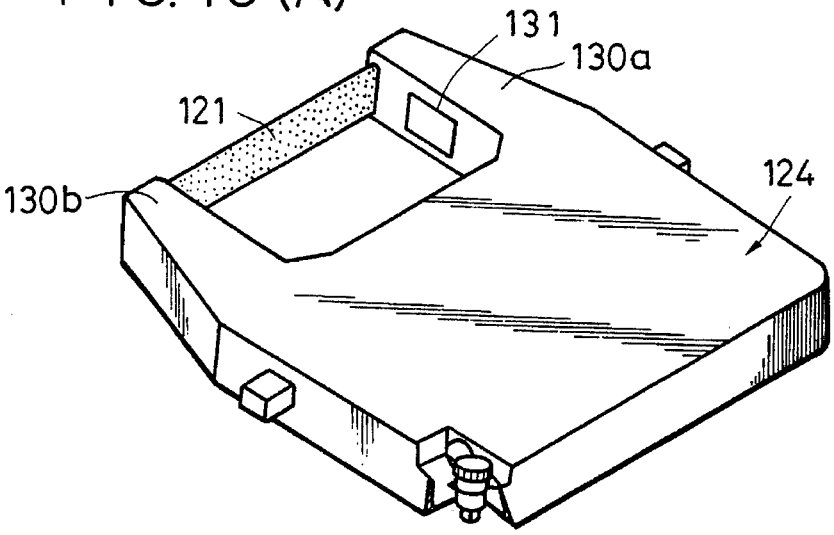
FIG. 10(A) shows an ink ribbon cassette used in the embodiment of FIG. 1.

FIG. 10(A) is a perspective view of an ink ribbon cassette 124 for accommodating the ink ribbon 121. The ink ribbon 121 extends between arms 130*a* and 130*b* of the ribbon cassette 124. The ink ribbon 121 is movable from the side of the arm 130*a* to the side of the arm 130*b*. An open portion 132 or a reflecting portion comprising a tape 133 is provided on an inner portion 131 of the arm 130*a*.

Figure 10B:
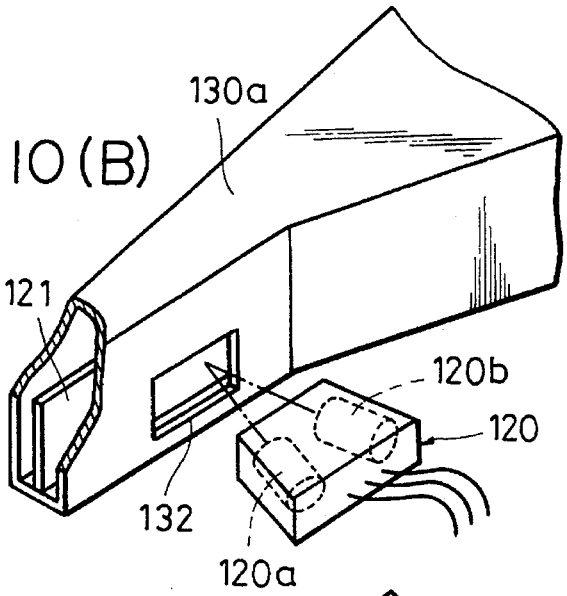
FIG. 10(B) is a schematic view of an example of an ink ribbon determination sensor portion used in the embodiment of FIG. 1.

FIG. 10(B) schematically shows an example of the ink ribbon detection sensor portion. A detection sensor 120 is a reflection type photosensor which includes a light-emitting element 120*a* and a light-receiving element 120*b*. The rear surface (the surface against which the character hammer strikes) of the ink sheet 121 is colored in a color which reflects the light from the light-emitting element 120*a*. The rear surface of the single strike ribbon and that on the multi-strike ink ribbon are colored in different colors having different reflectances so that the detection sensor 120 can detect the type of ink ribbon 121 accommodated in the ribbon cassette 124 mounted on the recording apparatus utilizing the difference in the reflectances.

Figure 10C:
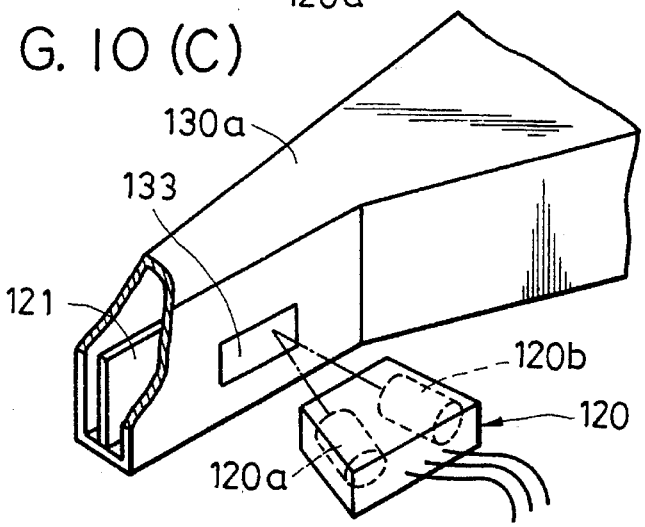
FIG. 10(C) is a schematic view of another example of the ink ribbon determination sensor portion used in the embodiment of FIG. 1.

FIG. 10(C) schematically shows another example of the ink ribbon detection sensor portion. The detection sensor 120 has the same configuration as that shown in FIG. 10(B). A tape 133 adheres to the inner surface of the arm 130*a* of the cassette 124. For example, a silver tape adheres to the cassette 124 which accommodates the single strike ribbon, and no tape adheres to the cassette 124 which accommodates the multi-strike ribbon. Thus, the detection sensor 120 can detect the type of ink ribbon accommodated in the cassette 124 by detecting the difference in the reflectance between the silver tape and the color of the cassette. The type of ink ribbon 121 may also be designated by the operator from the keyboard 100 or from a switch (not shown).

In this embodiment, a data table which lists the vertical displacement y and horizontal movement x of each ink ribbon is stored in the ROM 102. FIG. 8 shows this data table. In this example, the vertical movement y1 of the single strike ribbon 121*a* is set to 6 pulses, while the horizontal movement x1 thereof is set to 10 pulses. The vertical displacement y2 of the multi-strike ink ribbon 121*b* is set to 2 pulses, while the horizontal movement x2 thereof is set to 5 pulses. The RAM 103 stores the recording position of the ink ribbon 121. The aforementioned number of pulses are applied to the shift motor 118 and to ribbon feed motor 114.

Figure 9:
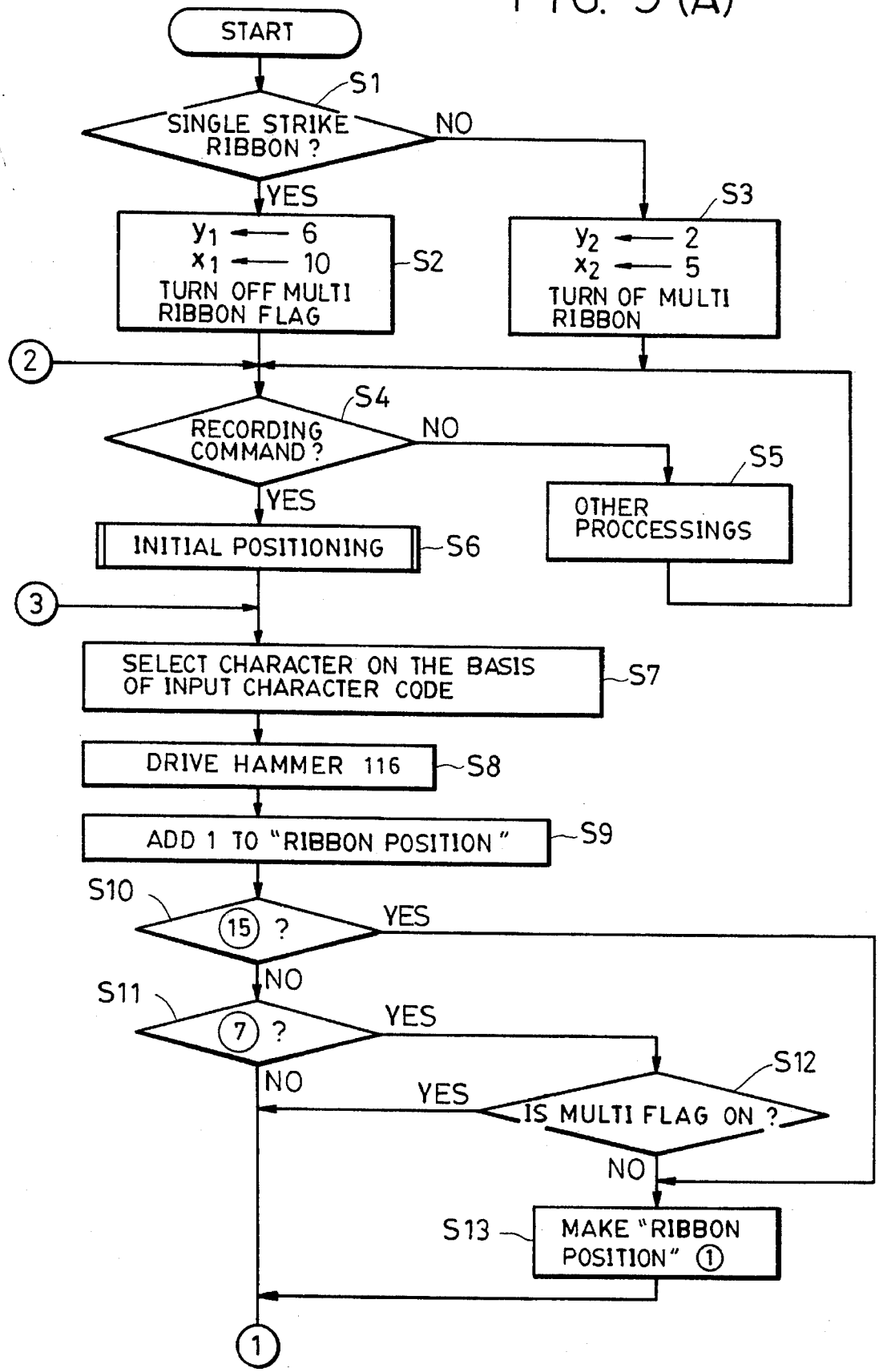
FIGS. 9(A) to 9(D) are flowcharts of the printing process executed in the electronic typewriter of the present invention.

FIG. 9 is a flowchart of the printing program executed by the MPU 101 which is stored in the ROM 102 of the control portion 106. This program is started when the MPU 101 receives a letter printing instruction from the keyboard 100.

First, it is determined in step S1 using the signal input from the ribbon detection sensor 120 whether or not the ink ribbon 121 is a single strike ribbon. If the type of ribbon is a single strike or correctable ribbon which allows the same portion to be struck only once, 6 pulses and 10 pulses are respectively selected as the vertical displacement y1 and the horizontal movement x1 in step S2, in order to prevent the same position of the ink ribbon 121*a* from being used twice for printing. At the same time, a multi-ribbon flag in the RAM 103 is turned off.

If the type of ink ribbon is determined to be a multi-strike ink ribbon 121*b* in step S1, 2 pulses and 5 pulses are respectively selected as the vertical displacement y2 and the horizontal movement x2 in step S3 so as to allow the same position of the multi-strike ink ribbon 121*b* to be used a plurality of times. This allows the multi-strike ink ribbon 121*b* to be used effectively. At the same time, a multi-ribbon flag, indicating that the multi-strike ink ribbon 121*b* is mounted on the recording apparatus, is turned on.

Next, it is determined in step S4 whether or not a printing instruction is input from the keyboard 100. If the input instruction is other than a printing instruction, the process goes to step S5 and the corresponding operation, such as the paper feed operation, will be conducted.

If printing is instructed, the process goes to step S6 and the ink ribbon 121 is shifted up from the waiting position shown in FIG. 3 by the shift motor 118 so that a subsequent recording position of the ink ribbon 121 can be located at a strike position on the basis of the recording position information on the ink ribbon 121 stored in the RAM 103. This initial positioning process will be described in detail below with reference to FIG. 9(C).

Figure 4:
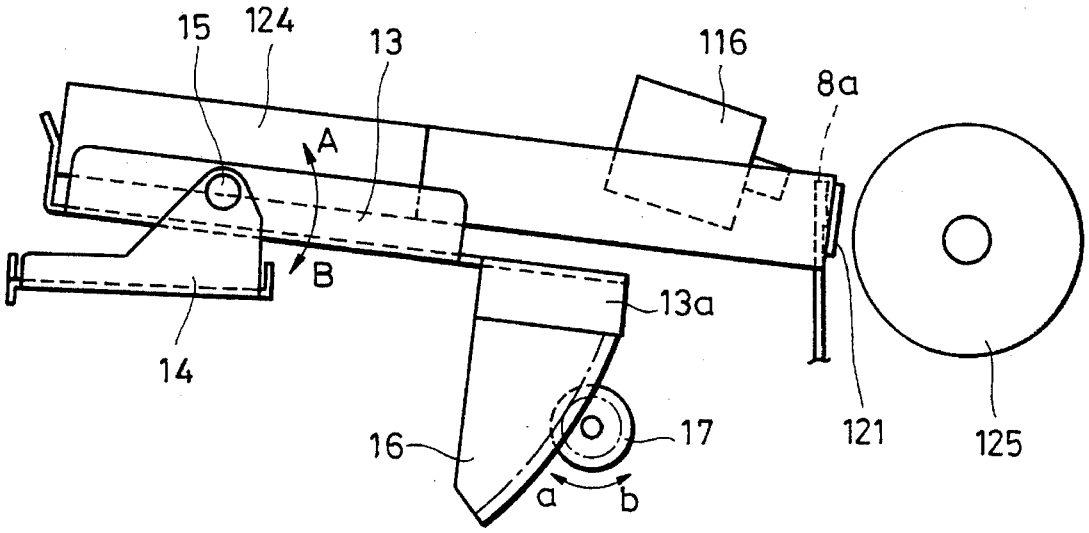
Figure 5:
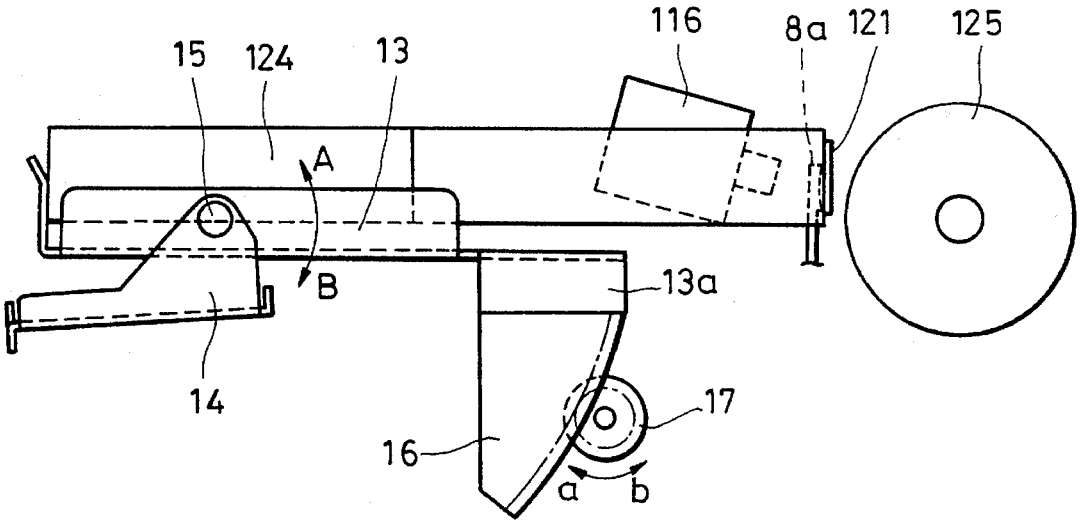

First, in step S21, the ink ribbon 121 is shifted up from the waiting state shown in FIG. 3 to a state shown in FIG. 4 in which the upper portion of the ink ribbon 121 can be used for recording. Next, it is determined in step S22 whether or not the multi-flag is on. If the multi-flag is on, i.e., if the multi-strike ink ribbon 121*b* is mounted, the process goes to step S23, and it is determined whether or not the ink ribbon position used for a subsequent recording is ribbon position ① or ⑧ shown in FIG. 7. If it is determined in step S7 that the ink ribbon position used for the subsequent recording is ① or ⑧, since the ink ribbon 121*b* must be conveyed by distance x2 in the direction of the x axis, as shown in FIG. 7, the ribbon feed motor 114 is driven by x2 pulses in step S24 so as to take up the ink ribbon 121 by an amount x2.

Next, in step S25, "1" is subtracted from the "ribbon position", and then it is determined in step S26 whether or not the result Y1 of the calculation made in strep S25 is larger than "6" so as to check whether or not the recording position of the multi-strike ink ribbon 121*b* shown in FIG. 7 corresponds to any position from ① to ⑦. That is, since the multi-strike ink ribbon 121*b* has been shifted to the vertical position ① or ⑭ (corresponding to FIG. 4), the distance through which the ink ribbon 121*b* is further shifted up in the direction indicated by the arrow 'A' from the state shown in FIG. 4 to attain a desired position from ① to ⑦ is obtained. If Y1 is not larger than "6", the process goes to step S27 and the shift motor 118 is driven by Y1×y2 pulses so as to rotate the pinion gear 17 in the direction indicated by the arrow 'a' to thereby shift up the multi-strike ink ribbon 121*b*.

If it is determined in step S26 that Y1 is larger than "6", since recording is conducted at a ribbon position which ranges from ⑧ to ⑭ shown in FIG. 7, the process goes to step S28 and 14-"ribbon position" =Y2 is calculated. Next, in step S29, the shift motor 118 is driven by Y2×y2 pulses so as to shift up the mink ribbon 121*b*, as in the case of step S27.

If it is determined in step S22 that the multi-flag is off, i.e., if the single ink ribbon 121*a* is used for recording, the process goes to step S30 and it is determined whether or not the ribbon recording position used for a subsequent recording is ① or ④. If the subsequent recording is conducted at the recording position ① or ④, since the single ink ribbon 121*a* must be conveyed by a distance x1 in the direction of the x axis, as shown in FIG. 6, the process goes to step S31 and ribbon feed motor 114 is rotated by x1 pulses so as to take up the ink ribbon 121*a* by an amount x1.

Next, in step S32, "1" is subtracted from "ribbon position", and then it is determined in step S33 whether or not the result Y3 of the calculation is larger than "2" so as to check whether or not the recording position of the single strike ribbon 121*a* shown in FIG. 6 corresponds to any position from ① to ③. That is, since the single strike ribbon 121*a* has been shifted to the vertical position ① or ⑥ (corresponding to FIG. 4), the distance through which the ink ribbon 121*a* is further shifted up in the direction indicated by the arrow 'A' from the state shown in FIG. 4 to attain a desired position from ① to ③ is obtained. If Y1 is not larger than "2" the process goes to step S34 and the shift motor 118 is rotated by Y3× y1 pulses so as to rotate the pinion gear 17 in the direction indicated by the arrow 'a' in FIG. 4 and thereby shift up the ink ribbon 121*a*.

If it is determined in step S33 that Y3 is larger than "2", since the subsequent recording position is the ribbon position from ④ to ⑥ shown in FIG. 6, the process goes to step S35 and 6-"ribbon position"=Y4 is calculated. Next, in step S36, the shift motor 118 is rotated by Y4× y1 pulses so as to shift up the ink ribbon 121*a*, as in the case of step S34.

In the above-described embodiment, the ink ribbon 121 is located at an initial position after it has been shifted up to the position which ensures that the upper portion thereof is located at the recording position. However, the ink ribbon 121 may be shifted up after it has been located at the waiting position.

After the ink ribbon has been located at the initial position, the process goes to step S7 and the wheel motor 117 is rotated on the basis of the letter code input from the keyboard 100 so as to select the character of the character wheel 123 corresponding to the letter code and locate it at a position where it is struck by the printing hammer 116. Thereafter, in step S8, the character 8*a* is struck by the printing hamer 116 for printing.

Next, in step S9, "1" is added to the ribbon recording position (see FIGS. 6 and 7) stored in the RAM 103, and then it is determined in step S10 whether or not the result of the addition is (15). If the answer is yes, ① is stored in the RAM 103 as the recording position in step S13. If the answer is no, the process goes to step S11 and it is determined whether or not the recording position of the ribbon 121 is ⑦. If the recording position is not ⑦, the process goes to step S14. If the recording position is ⑦, the process goes to step S12 and it is determined whether or not the multi-flag is on. This is because the recording position of the ribbon must be changed to ① when the single strike ribbon 121*a* has been mounted, as shown in FIG. 6, whereas it is not necessary to change the recording position in the case of the multi-strike ink ribbon 121*b*. If the single strike ribbon is mounted, ① is thus stored in the RAM 103 as the recording position of the ribbon.

When the recording position of the ink ribbon 121 has been updated, the carriage motor 115 is driven so as to move the carriage 122 to a subsequent printing position in step S14. Next, it is determined in step S15 whether or not there is a subsequent printing instruction. If there is no subsequent printing instruction, the shift motor 118 is rotated so as to shift down the ink ribbon 121 to the waiting position shown in FIG. 3 in step S16. In contrast, if there is a subsequent printing instruction, positioning of the ink ribbon 121 is conducted for a subsequent printing in step S17, and then the process proceeds to step S7.

Figure 9B:
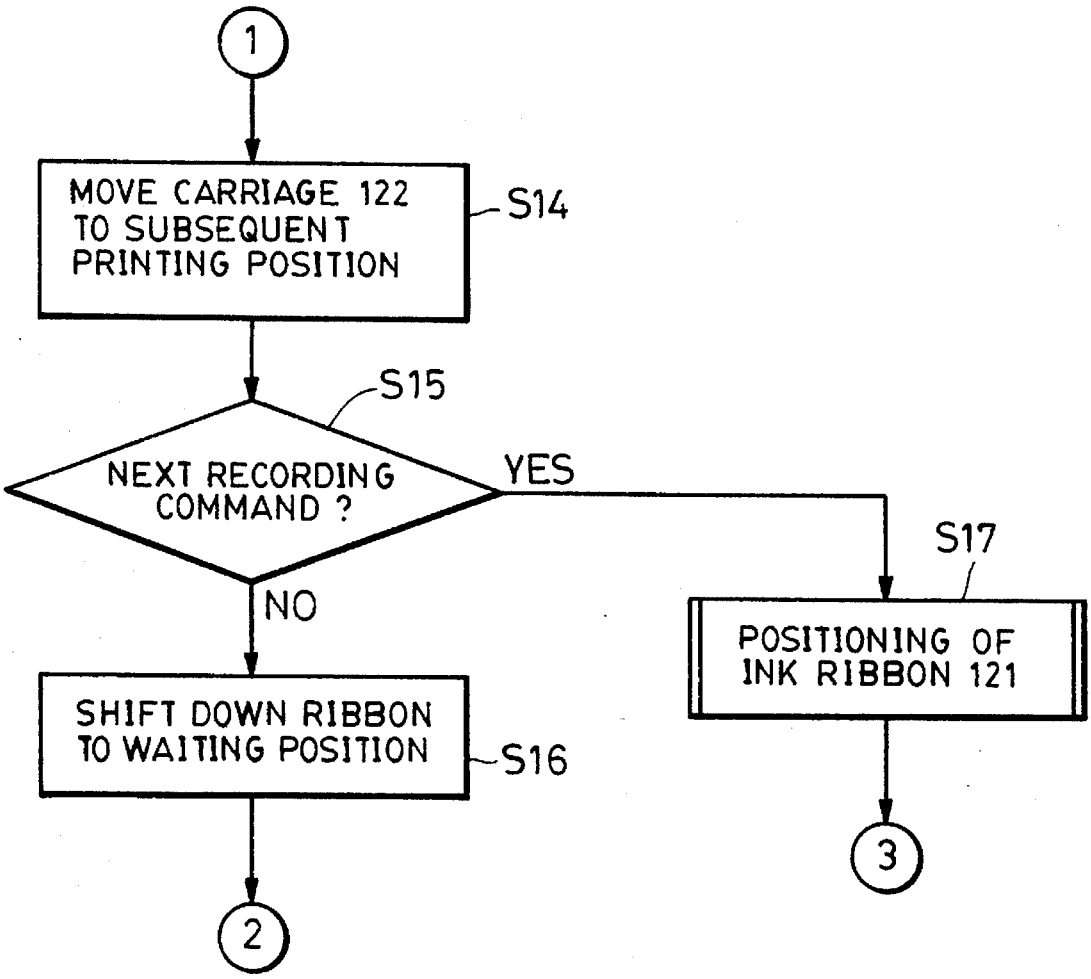
Figure 9:
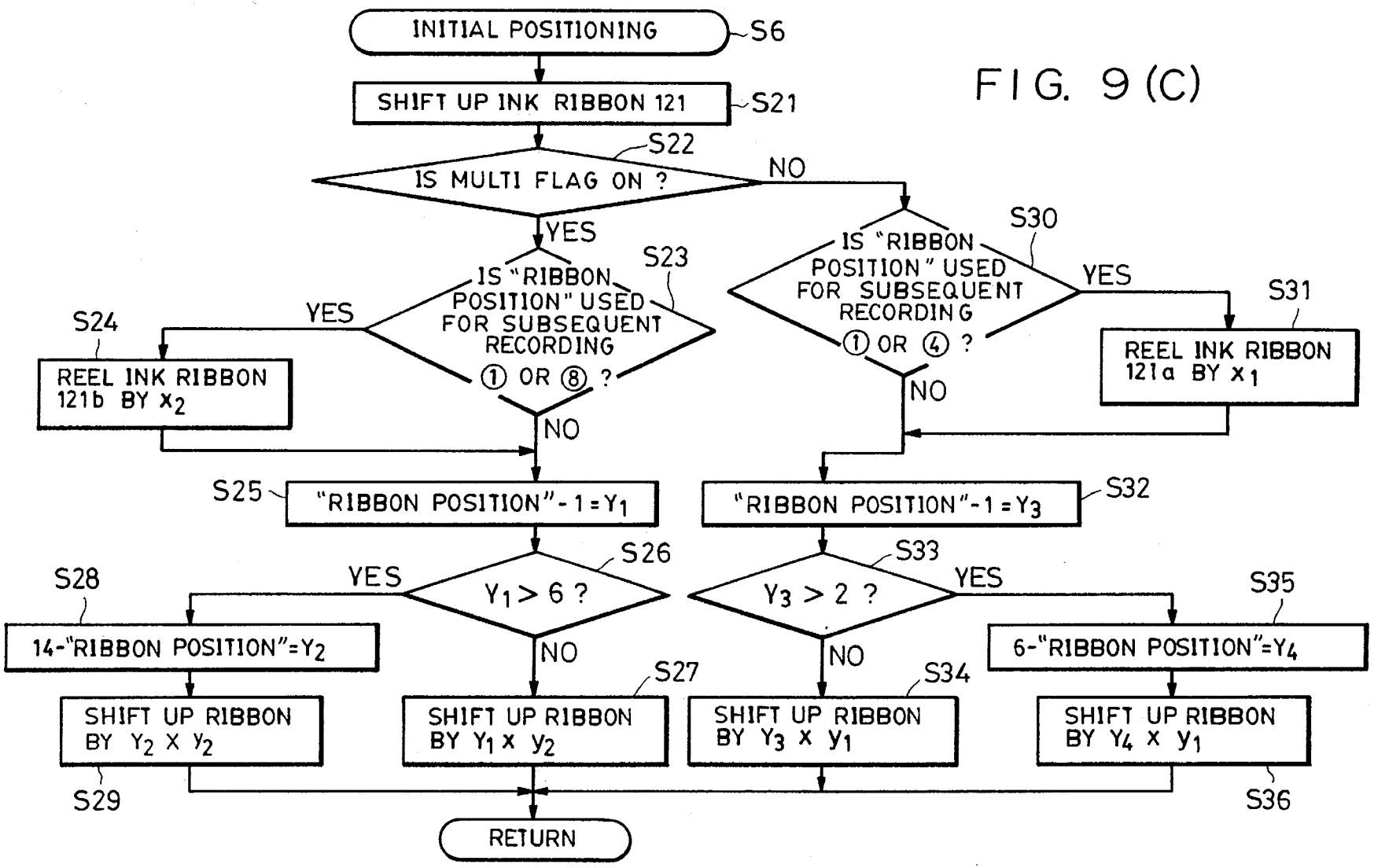
Figure 9:
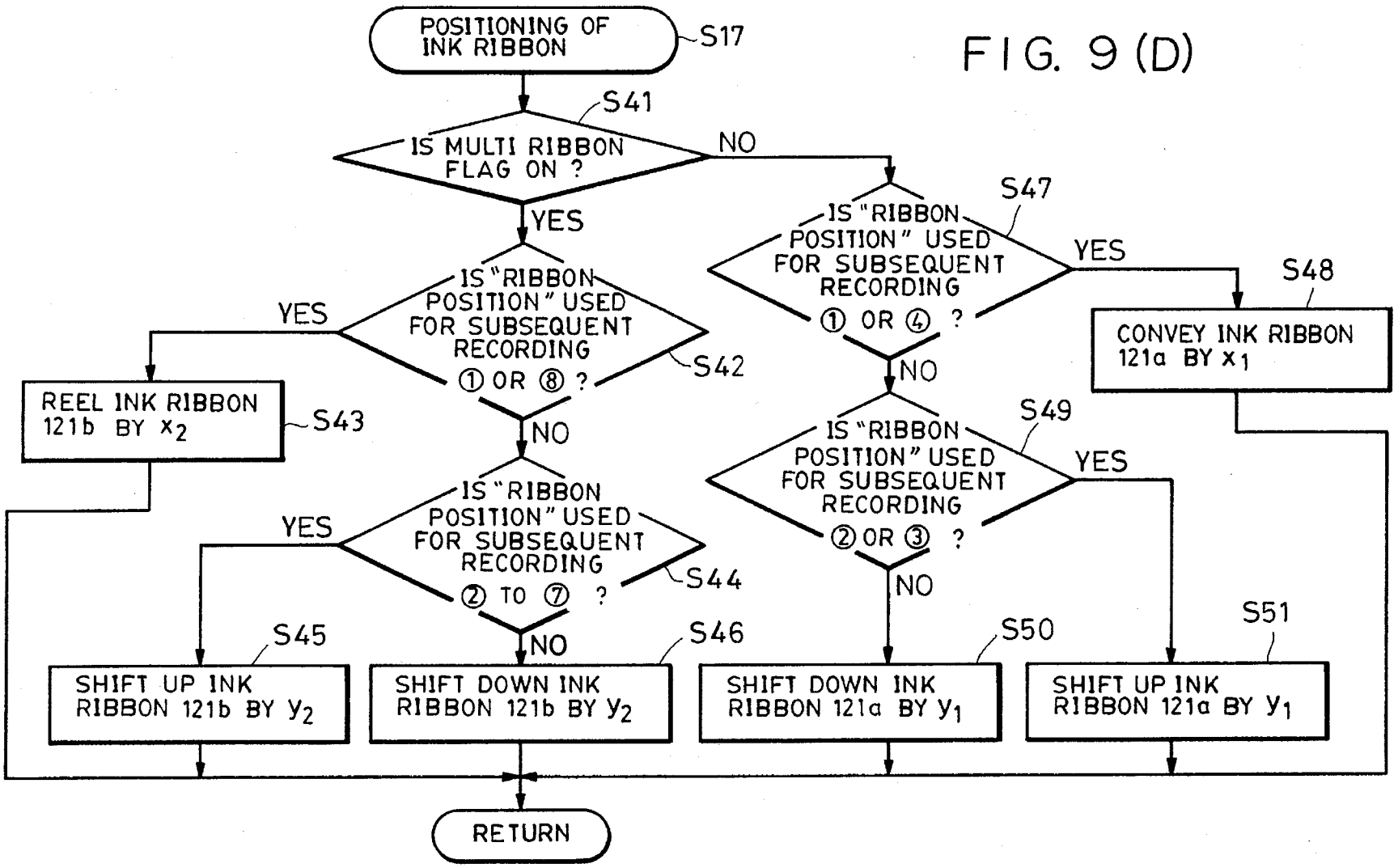

FIG. 9(D) is a flowchart showing the process of positioning the ink ribbon 121 executed in step S17 in FIG. 9(B).

First, it is determined in step S41 whether or not the multi-strike ink ribbon 121*b* is used. If the multi-strike ink ribbon 121*b* is used, it is determined in step S42 whether or not the subsequent recording position is ① or ⑧ shown in FIG. 7. If the answer is yes, the ribbon feed motor 114 is driven by x2 pulses so as to take up the ink ribbon 121*b* in step S43. If the subsequent recording position is not ① or ⑧ shown in FIG. 7, it is determined in step S44 whether or not the subsequent recording position is any position from ② to ⑦. If the answer is yes, the shift motor 118 is driven by y2 pulses in step S45 so as to rotate the pinion gear 17 in the direction indicated by the arrow 'a' and thereby shift up the ink ribbon 121. If the subsequent recording position is not from ② to ⑦, the shift motor 118 is driven by y2 pulses so as to rotate the pinion gear 17 in the direction indicated by the arrow 'b' and thereby shift down the ink ribbon 121.

If it is determined in step S41 that the multi-strike ink ribbon 121*b* is not mounted, the process goes to step S47 and it is determined whether or not the recording position of the ink ribbon used for a subsequent recording is either ① or ④ (see FIG. 6). If the subsequent recording position is either ① or ④, the ribbon feed motor 114 is driven by x1 pulses so as to convey the ink ribbon 121*a*. If the subsequent recording position is neither ① nor ④, it is determined in step S49 whether or not the subsequent recording position is either ② or ③. If the answer is yes, the shift motor 118 is driven by y1 pulses in step S51 so as to rotate the pinion gear 17 in the direction indicated by the arrow 'a' and thereby shift up the ink ribbon 121*a* in the direction indicated by the arrow 'A' of FIG. 4.

If it is determined in step S49 that the subsequent recording position is neither ② nor ③, the shift motor 118 is driven by y1 pulses in step S50 so as to rotate the pinion gear 17 in the direction indicated by the arrow 'b' and thereby shift down the ink ribbon 121*a* in the direction indicated by the arrow 'B' of FIG. 4.

In the above-described embodiment, the displacement and movement of the single strike ribbon 121*a* or the correctable ribbon are respectively set to y1 and x1. Consequently, even when the ink ribbon is used in three stages in the vertical direction, the same position thereof is not used a second time. The displacement and movement of the multi-strike ink ribbon 121*b* are respectively set to y2 (=y1 / 3) and x2 (=x1 / 2). This allows the multi-strike ink ribbon 121*b* to be used in seven stages in the vertical direction and in such a manner that the recording positions thereof are overlapped in both the vertical and horizontal directions. As a result, the efficient use of the ink sheet 121*b* is achieved.

In the above-described embodiment, when printing is conducted, the displacement of the ink ribbon is changed in both the vertical and horizontal directions in accordance with the type of ink ribbon. However, the movement of the ink ribbon in the horizontal direction may be fixed.

Furthermore, in the aforementioned embodiment, two types of ink ribbons are used. However, since the degree with which the recording positions of the multi-strike ink ribbons are overlapped differs depending on the type of ink ribbon, it may be arranged such that a larger number of displacements or movements can be attained during recording. This is achieved by further detailing the data table for listing the displacements and movements.

Furthermore, when correction is to be made, the vertical displacement and horizontal movement of a correction ink ribbon may be changed in accordance with the type of correction ink ribbon.

Figure 12:
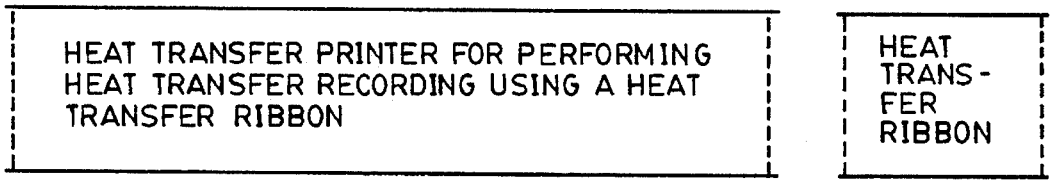
FIG. 12 shows a block diagram of an alternative embodiment in which a heat transfer printer is used in place of the hammer-type printer shown in FIGS. 1 to 5 and FIGS. 10(A) to 10(D)
Figure 13:
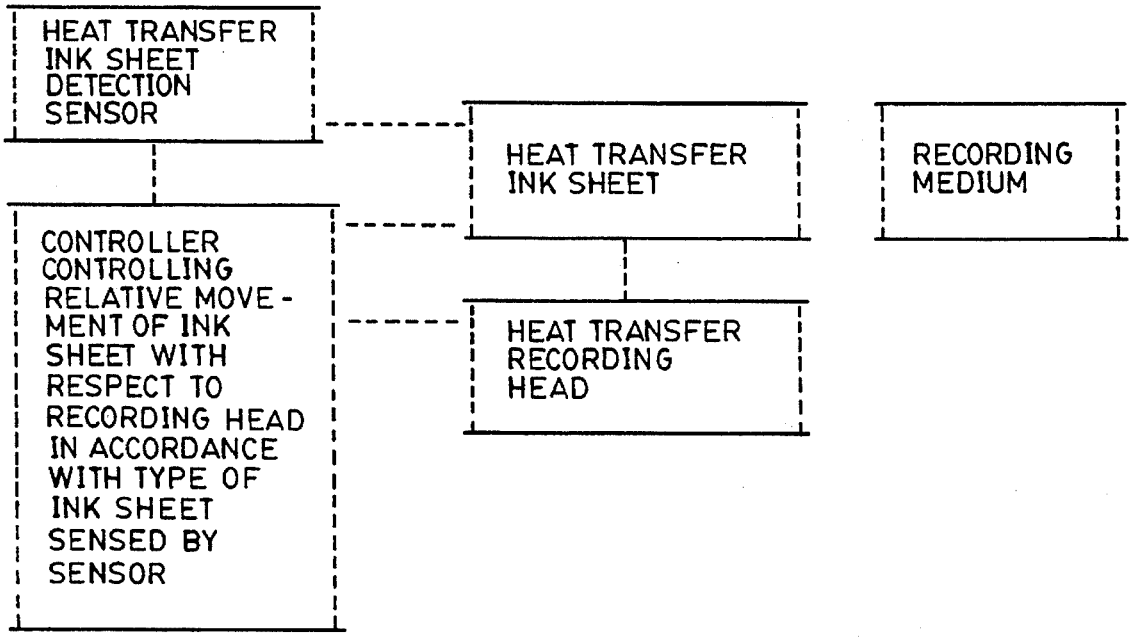
FIG. 13 shows a block diagram, in more detail than FIG. 12, of the alternative embodiment of the heat transfer printer.

Furthermore, in the above-described embodiment, a hammer-type printer has been described. However, the present invention is not limited to this but it can also be applied to a heat-transfer printer for conducting heat transfer recording using a heat-transfer type ink ribbon, as shown in FIGS. 12 and 13.

In the aforementioned embodiment, an electronic typewriter has been described. However, the present invention can also be applied to an image output terminal of information processing apparatus, such as a computer, a coping machine combined with a reader or to a facsimile machine having transmission and reception functions.

The above-described embodiment has the following advantages.

(1) Since the vertical displacement by which the ink ribbon is shifted during recording is changed in accordance with the type of ink ribbon, the efficiency with which the ink ribbon is used can be enhanced.

(2) Since the vertical displacement by which the ink ribbon is shifted and the horizontal movement by which the ink ribbon is conveyed during recording are changed in accordance with the type of ink ribbon, when the multi-strike ink ribbon which permits the same position to be used a plurality of times is used, the efficiency with which the ink ribbon is used can be enhanced in both the vertical and horizontal direction. When the single strike ink ribbon which permits the same position thereof to be used once is used, the same position of the ink ribbon is never used twice for printing, and high quality recording can thus be attained.

The individual components represented by the blocks shown in FIGS. 1 and 11 to 13 are well known in the recording art and their specific construction and operation is not critical to the invention or the best mode for carrying out the invention. Moreover, the operations illustrated in FIGS. 9(A) to 9(D) can be easily programmed into well known central processing units or microprocessing units by persons of ordinary skill in the art and since such programing per se is not part of the invention, nor further description thereof is deemed necessary.

As will be understood from the foregoing description, since the relative movement of the ink sheet with respect to the recording head can be changed during recording in accordance with the type of ink sheet, the efficiency with which the ink sheet is used can be improved.

What is claimed is:

1. A recording apparatus for performing recording by transferring ink on an ink :sheet onto a recording medium, comprising:

discriminating means for discriminating the type of ink sheet performing a predetermined movement for recording in vertical and horizontal directions with respect to the longitudinal direction of the surface thereof;

recording means for performing recording by transferring the ink on the ink sheet onto the recording medium;

a shift motor coupled to an ink sheet supporting member, wherein activation of said shift motor moves the ink sheet supporting member vertically with respect to said recording means, thereby moving the ink sheet vertically with respect to said recording means;

an ink sheet feed motor, coupled to a taking up mechanism taking up the ink sheet, wherein activation of said ink sheet feed motor causes the taking up mechanism to move the ink sheet horizontally with respect to said recording means; and programmed automatic control means for automatically controlling said shift motor to move the ink sheet vertically with respect to said recording means in accordance with selected data relating to the type of ink sheet discriminated by said discriminating means and for automatically controlling said ink sheet feed motor to move the ink sheet horizontally with respect to said recording means in accordance with selected data relating to the type of the ink sheet discriminated by said discriminating means.

2. The recording apparatus according to claim 1, wherein said discriminating means mechanically detects the configuration of a portion of a cassette for accommodating the ink sheet in accordance with the type of accommodated ink sheet.

3. The recording apparatus according to claim 1, wherein said discriminating means optically detects the reflectance of cassettes for accommodating different ink sheets, wherein cassettes accommodating different ink sheets have different reflectances, and wherein said discriminating means discriminates the type of ink sheet in accordance with the difference in reflectances of the different cassettes.

4. The recording apparatus according to claim 1, wherein said discriminating means optically detects the reflectance of the rear surfaces of different types of ink sheets, wherein the rear surfaces of different types of ink sheets have different reflectances, and wherein said discriminating means discriminates the type of ink sheet in accordance with the difference in reflectances of the rear surfaces of different types of ink sheets.

5. The recording apparatus according to claim 1, wherein said ink sheet comprises a single strike ribbon, a multi-strike ribbon or a correction ink ribbon.

6. The recording apparatus according to claim 1, wherein said recording means comprises a printer for performing recording comprising a character wheel and a hammer, wherein said hamer is adapted to strike a character on said character wheel, thereby pressing the character against the ink sheet, and thereby transferring the ink on the ink sheet onto the recording medium.

7. The recording apparatus according to claim 1, wherein the ink sheet is a heat-transfer ink ribbon, and wherein said recording means comprises a heat-transfer printer for performing heat-transfer recording using the heat-transfer ink ribbon.

8. The recording apparatus according to claim 1, wherein said recording apparatus is an electronic typewriter.

9. A recording apparatus for performing recording on a recording medium by striking an ink sheet with a character hammers comprising:

discriminating means for discriminating the type of either a single strike ink sheet or a multi-strike ink sheet to be used for recording;

recording means for performing recording by transferring the ink on the ink sheet onto the recording medium, said recording means comprising a recording head adapted to strike the character against the ink sheet to perform recording;

a shift motor coupled to an ink sheet supporting member, wherein activation of said shift motor moves the ink sheet supporting member vertically with respect to said recording means, thereby moving the ink sheet vertically with respect to said recording means;

an ink sheet feed motor, coupled to a taking up mechanism taking up the ink sheet, wherein activation of said ink sheet feed motor causes the taking up mechanism to move the ink sheet horizontally with respect to said recording means; and programmed automatic control means for automatically controlling said shift motor to move the ink sheet vertically with respect to said recording means in accordance with selected data relating to the type of ink sheet discriminated by said discriminating means and for automatically controlling said ink sheet feed motor to move the ink sheet horizontally with respect to said recording means in accordance with selected data relating to the type of the ink sheet discriminated by said discriminating means.

10. The recording apparatus according to claim 9, further comprising displacing means for displacing the ink sheet in the vertical direction relative to said recording means, and wherein said controlling means controls said displacing means to change the vertical displacement in accordance with the selected data.

11. The recording apparatus according to claim 10, wherein said controlling means controls the distance the ink sheet is conveyed in a horizontal direction relative to said recording means in accordance with the selected data.

12. The recording apparatus according to claim 9, wherein said discriminating means mechanically detects the configuration of a portion of a cassette for accommodating the ink sheet in accordance with the type of accommodated ink sheet.

13. The recording apparatus according to claim 9, wherein the ink sheet comprises a single strike ribbon, a multi-strike ribbon or a correction ink ribbon.

14. The recording apparatus according to claim 9, wherein said recording apparatus is an electronic typewriter.

15. A recording method for performing recording by transferring ink on an ink sheet onto a recording medium, comprising the steps of:

determining the type of ink sheet to be used for recording;

performing recording by transferring the ink on the ink sheet onto the recording medium with recording means;

moving the ink sheet vertically with respect to the recording means with a shift motor and moving the ink sheet horizontally with respect to the recording means with an ink sheet feed motor; and automatically controlling the shift motor to move the ink sheet vertically with respect to the recording means in accordance with selected data relating to the type of ink sheet determined in said determining step and automatically controlling the ink sheet feed motor to move the ink sheet horizontally with respect to the recording means in accordance with selected data relating to the type of ink sheet determined in said determining step.

16. A recording apparatus for performing recording by transferring ink on an ink sheet onto a recording medium, comprising:

discriminating means for discriminating the type of ink sheet performing a predetermined movement for recording in substantially parallel and normal directions with respect to the longitudinal direction of the surface thereof;

recording means for performing recording by transferring the ink on the ink sheet onto the recording medium;

a shift motor, coupled to an ink sheet supporting member, wherein activation of said shift motor moves the ink sheet supporting member normal with respect to said recording means, thereby moving the ink sheet, vertically with respect to said recording means;

an ink sheet feed motor, coupled to a taking up mechanism taking up the ink sheet, wherein activation of said ink sheet feed motor causes the taking up mechanism to move the ink sheet horizontally with respect to said recording means; and programmed automatic control means for automatically controlling the shift motor to move the ink sheet normal with respect to the direction in which the ink sheet is conveyed along the recording surface thereof with respect to said recording means in accordance with selected data relating to the type of ink sheet discriminated by said discriminating means and for automatically controlling said ink sheet feed motor to move the ink sheet in a direction substantially parallel to the direction in which the ink sheet is conveyed along the recording surface thereof, with respect to said recording means in accordance with selected data relating to the type of the ink sheet discriminated by said discriminating means.

17. The recording apparatus according to claim 16, wherein said recording apparatus is an electronic typewriter.

18. A recording method for performing recording by transferring an ink sheet in substantially parallel and normal directions with respect to the direction in which the ink sheet is conveyed and striking a recording sheet with a hammer, said recording method being capable of choosing the type of the ink sheet to be used between a single strike ink sheet and a multi-strike ink sheet and comprising the steps of:

discriminating whether the ink sheet used for recording is the single strike ink sheet or the multi-strike ink sheet; and performing recording by automatically controlling the method so as to reduce, if the sheet discriminated is the multi-strike ink sheet, the movement of the multi-strike ink sheet being transferred in substantially parallel and normal directions with respect to the direction in which the ink sheet is conveyed in comparison with the single strike ink sheet by automatically controlling a shift motor to move the ink sheet substantially normal with respect to the direction in which the ink sheet is conveyed in accordance with selected data relating to the type of ink sheet determined in said discriminating step and by automatically controlling an ink sheet feed motor to move the ink sheet substantially parallel with respect to the direction in which the ink sheet is conveyed in accordance with selected data relating to the type of ink sheet determined in said discriminating step.

* * * * *

UNITED STATES PATENT AND TRADEMARK OFFICE

CERTIFICATE OF CORRECTION

PATENT NO. : 5,490,733

DATED : February 13, 1996

INVENTOR(S) : Shinya ASANO

It is certified that error appears in the above-indentified patent and that said Letters Patent is hereby corrected as shown below:

ON THE COVER PAGE

[56] References Cited - FOREIGN PATENT DOCUMENTS:

"1218879 9/1989 Japan" should read --1-218879 9/1989 Japan--.

SHEET 7 OF THE DRAWINGS

FIG. 9(A), IN STEP S3:

"TURN OF MULTI RIBBON" should read --TURN ON MULTI RIBBON FLAG--.

COLUMN 1:

Line 34, "times,. Such" should read --times, such--.

COLUMN 4:

Line 15, "8" should read --a--.

COLUMN 6:

Line 7, "hamer" (both occurrences) should read --hammer--.

UNITED STATES PATENT AND TRADEMARK OFFICE

CERTIFICATE OF CORRECTION

PATENT NO. : 5,490,733

DATED : February 13, 1996

INVENTOR(S) : Shinya ASANO

It is certified that error appears in the above-indentified patent and that said Letters Patent is hereby corrected as shown below:

COLUMN 7:

Line 59, "strep" should read --step--.

COLUMN 8:

Line 11, "mink" should read --ink--.
Line 58, "hamer" should read --hammer--.

COLUMN 10:

Line 31, "coping" should read --copying--.

COLUMN 11:

Line 3, ":sheet" should read --sheet--.
Line 58, "hamer" should read --hammer--.

UNITED STATES PATENT AND TRADEMARK OFFICE

CERTIFICATE OF CORRECTION

PATENT NO. : 5,490,733 Page 3 of 3

DATED : February 13, 1996

INVENTOR(S) : Shinya ASANO

It is certified that error appears in the above-indentified patent and that said Letters Patent is hereby corrected as shown below:

COLUMN 12:

Line 5, "hammers" should read --hammer,--.

Signed and Sealed this

First Day of October, 1996

*Attest:*

Bruce Lehman

BRUCE LEHMAN

*Attesting Officer*

*Commissioner of Patents and Trademarks*